United States Patent [19]

Kimura et al.

[11] 4,303,846

[45] Dec. 1, 1981

[54] SINTERED ELECTRODE IN A DISCHARGE TUBE

[75] Inventors: Sakae Kimura, Yokota; Masahiro Shimura, Yokohama; Kenji Enokida, Yokosuka; Hideharu Nihei, Yokohama, all of Japan

[73] Assignee: Toshiba Corporation, Kawasaki, Japan

[21] Appl. No.: 112,452

[22] Filed: Jan. 16, 1980

[30] Foreign Application Priority Data

Jan. 22, 1979 [JP] Japan ..... 54-4765

[51] Int. Cl.[3] ..... H01J 61/04; H01J 61/26

[52] U.S. Cl. ..... 313/178; 313/218; 313/346 R

[58] Field of Search ..... 313/178, 218, 355, 346 R, 313/213

[56] References Cited

U.S. PATENT DOCUMENTS

| | | | |
|---|---|---|---|
| 3,521,107 | 7/1970 | Zemel et al. | 313/178 |
| 3,758,184 | 9/1973 | Menzel | 313/218 X |
| 3,849,690 | 11/1974 | Cosco et al. | 313/218 X |
| 3,970,888 | 7/1976 | Trattner | 313/346 R |
| 4,002,940 | 1/1977 | Ekkelboom et al. | 313/346 R |
| 4,097,774 | 6/1978 | Cosco et al. | 313/346 R X |
| 4,152,620 | 5/1979 | Bhalla | 313/218 |

FOREIGN PATENT DOCUMENTS

| | | |
|---|---|---|
| 2059572 | 8/1971 | Fed. Rep. of Germany . |
| 47-28180 | 3/1972 | Japan . |
| 49-24575 | 5/1974 | Japan . |

*Primary Examiner*—Palmer C. Demeo

*Attorney, Agent, or Firm*—Schuyler, Banner, Birch, McKie & Beckett

[57] ABSTRACT

A sintered electrode in a discharge tube comprises a sintered compact body and a cesium compound layer deposited on the sintered compact body. The sintered compact body comprises a gas getter such as titanium in the range of 5 to 50% by weight of the body, an additive for sintering such as silicon oxide in the range 0.1 to 1.0% by weight of the body and the remainder formed by a high melting point metal such as tantalum.

5 Claims, 3 Drawing Figures

SINTERED ELECTRODE IN A DISCHARGE TUBE

BACKGROUND OF THE INVENTION

The present invention relates to a sintered electrode used in a discharge tube.

In general, a discharge tube such as a flashing discharge lamp, an arrester tube, a quenching tube and so on is provided with a pair of electrodes, at least one of them having electron emissive material in the metal body. The discharge tube is filled with inert gas such as xenon. The tube has a discharge characteristic determined by the distance between the electrodes, the envelope diameter, the kind of sealed gas and the pressure thereof. Typically, discharge tubes are used as light sources for photographs, strobes and light sources for preventing overcurrent in automatic light controlled devices.

In recent years, discharge tubes have been miniaturized, e.g., photoflash tubes for cameras. Consequently, the electrodes installed within the small space provided by the envelope of these miniaturized discharge tubes must have increased thermal resistence and an anti-ion bombardment property. Tungsten, molybdenum, tantalum and niobium have been used to form these electrodes since these metals are high melting point metals. These electrodes further contain electron emissive materials such as alkaline earth metal compounds and alkali metal compounds.

A typical electrode used in discharge tubes is a sintered electrode manufactured by the steps of compacting, compressing and sintering a high melting point metal powder with electron emissive material. It is also common to add a powder made of low melting point metal such as nickel and cobalt to improve sintering. Also, in order to purify gases within the envelope, a gas getter is often added to the electrode. The gas getter may be a metal such as a barium-aluminum alloy, titanium or zirconium.

In recent years, the sintered electrode used in miniaturized discharge tubes has been made of metals comprising tungsten as a main component, an additive for sintering, such as nickel, and an electron emissive material. An electrode made of these metals is suitable for a discharge tube operating with a relatively small current. On the other hand, when the electrode is used for a discharge tube discharging instantaneously large currents, such as a photo-flash tube, blackening of the tube occurs and the life of the tube is reduced because the nickel, which is necessary for easy sintering, evaporates from the electrode. Moreover, the starting voltage of the discharge tube is affected by undesired impurity gas created within the envelope. As a result, upon repeated discharges, the starting voltage increases. Although the undesired gas can be removed by disposing a gas getter within the envelope, the limited space within the envelope of a miniaturized discharge tube makes it difficult to include a gas getter.

SUMMARY OF THE INVENTION

It is an object of this invention to provide a sintered electrode for a discharge tube to result in a relatively low initial starting voltage. It is a further object of this invention to provide a sintered electrode resulting in operation of the tube at stabilized starting voltages. It is another object of this invention to provide a sintered electrode with reduced blackening and long life.

According to the present invention, a sintered electrode comprises a sintered compact body which is a mixture of a high melting point metal, a gas getter and an additive for sintering. A cesium compound layer is disposed on the sintered compact body. In the sintered compact body, the gas getter is in the range 5 to 50% by weight, the additive for sintering is in the range of 0.1 to 1.0% by weight and the remainder is the high melting point metal. The cesium compound layer is made of cesium carbonate deposited on the sintered compact body.

DETAILED DESCRIPTION OF THE PREFERRED EMBODIMENT

Figure 1:
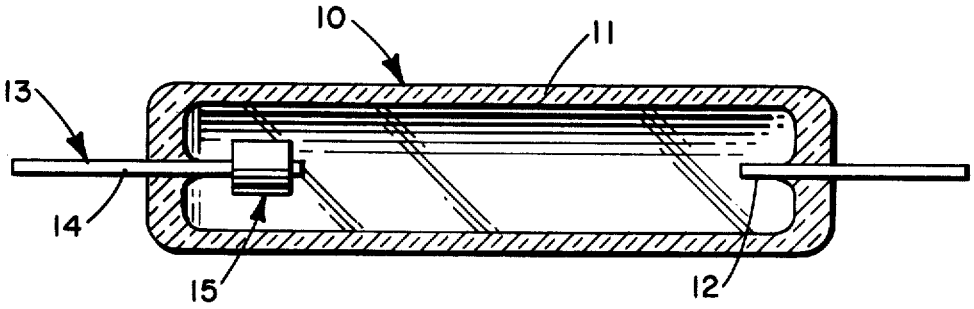
FIG. 1 is a longitudinal sectional view of a discharge tube incorporating the sintered electrode of the present invention.
Figure 2:
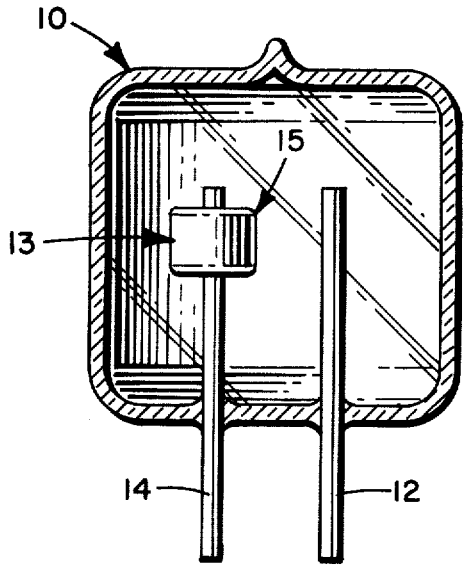
FIG. 2 is a longitudinal sectional view of another embodiment of a discharge tube incorporating the sintered electrode of the present invention.
Figure 3:
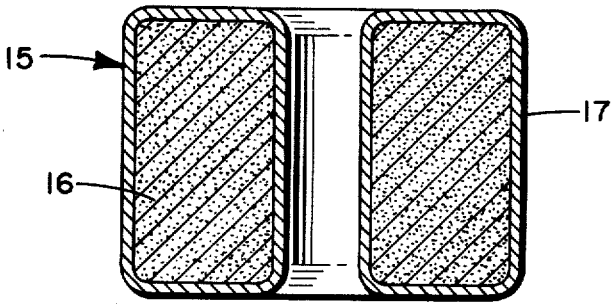
FIG. 3 is an enlarged sectional view of the sintered electrode of the present invention.

Referring now to FIGS. 1–3, the discharge tube 10 includes a transparent glass envelope 11 and two electrodes 12 and 13 within the envelope 11. Electrode 12, which is the cathode, is a tungsten rod 14 with a sintered electrode 15 fixed at the end of the rod 14. An inert gas such as xenon fills the envelope 11.

As shown in FIG. 3, sintered electrode 15 comprises a sintered compact body 16 and a cesium compound layer 17. The sintered compact body 16 comprises metal with a high melting point, a gas getter and an additive for sintering. The gas getter forms about 5 to 50% by weight of the sintered compact body 16, the additive for sintering forms about 0.1 to 1.0% by weight of the sintered compact body 16 and the high melting point metal forms the remainder by weight of the sintered compact body.

The sintered compact body 16 is formed by compacting, compressing and sintering a powder containing a mixture of a high melting point metal, a gas getter and an additive for sintering. The high temperature melting point metal can be made of a metal selected from the group consisting of tungsten (W), molybdenum (Mo), tantalum (Ta), niobium (Nb) and mixtures thereof. The gas getter can be made of a metal selected from the group consisting of titanium (Ti), zirconium (Zr), vanadium (V), hafnium (Hf) and mixtures thereof.

When the gas getter is less than 5% by weight, the gas getting effect of the sintered electrode 15 is reduced so that undesired gas within the envelope 11 is not absorbed thoroughly. As a result the starting voltage of the discharge tube increases. When the gas getter is more than 50% by weight, the metal evaporates and blackening occurs due to heating and ion bombardment.

The additive for sintering, which forms about 0.1 to 1.0% by weight of the sintered electrode 15, improves the fluidity of the mixed powder and promotes sintering. The additive comprises an oxide selected from the group consisting of silicon oxide ($SiO_2$), aluminum oxide ($Al_2O_3$) and mixtures thereof. The additive may be a powder having an average particle diameter less than 0.1 μm. Particle diameters greater than 0.1 μm do not provide sufficient sintering.

The cesium compound layer 17 is a cesium carbonate compound which is easily formed on the sintered compact body 16 at a predetermined thickness. The cesium carbonate compound deposited on the sintered compact body 16 is dissociated and releases carbon dioxide gas upon heating during manufacturing of the discharge tube. As a result, the cesium carbonate compound forms a cesium compound layer 17 such as cesium oxide or other compound. The cesium compound layer 17 enables the discharge tube to operate at relatively low starting voltage.

The present invention can be further explained by the following example and comparisons.

starting voltage and observing the blackening of the inner wall of the envelope during repeated discharges. The discharge conditions are as follows: applied voltage across the electrodes equals 300 V, trigger voltage equals 6Kv and condenser capacitance is 600 microFarads. A number of different examples of sintered compact bodies are given below for comparison. Examples 2-3, 5-6 and 8-14 are made in accordance with the sintered electrode of the present invention whereas examples 1, 4, 7 and 15-17 are not made according to the present invention but are given for the purpose of comparison.

| EXAMPLE NUMBER | COMPONENTS OF SINTERED COMPACT BODY | STARTING VOLTAGE (V) INITIAL STAGE | 100 TIMES DISCHARGE | 1000 TIMES DISCHARGE | 10000 TIMES DISCHARGE | AMOUNT OF BLACKENING |
|---|---|---|---|---|---|---|
| 1 Comparison Only | Ta-1.0 wt % $SiO_2$ | 155 | 180 | 220 | 285 | Slight |
| 2 | Ta-5 wt % Ti-0.8 wt % $SiO_2$ | 155 | 150 | 150 | 170 | None |
| 3 | Ta-25 wt % Ti-0.4 wt % $SiO_2$ | 150 | 150 | 150 | 155 | None |
| 4 Comparison Only | Ta-25 wt % Ti | 150 | 190 | 210 | 270 | Considerable |
| 5 | Ta-25 wt % Ti-0.8 wt % $Al_2O_3$ | 150 | 150 | 155 | 155 | None |
| 6 | Ta-50 wt % Ti-0.4 wt % $SiO_2$ | 155 | 155 | 160 | 200 | None |
| 7 Comparison Only | Ta-75 wt % Ti-0.2 wt % $SiO_2$ | 155 | 160 | 180 | 290 | Slight |
| 8 | Ta-10 wt % Zr-0.5 wt % $SiO_2$ | 155 | 155 | 150 | 155 | None |
| 9 | Ta-10 wt % Hf-0.5 wt % $SiO_2$ | 160 | 165 | 190 | 200 | None |
| 10 | W-10 wt % Ti-0.5 wt % $SiO_2$ | 165 | 160 | 160 | 165 | None |
| 11 | W-10 wt % V-0.5 wt % $SiO_2$ | 170 | 175 | 170 | 180 | None |
| 12 | Mo-25 wt % Ti-0.4 wt % $SiO_2$ | 190 | 200 | 190 | 195 | None |
| 13 | Nb-25 wt % Ti-0.4 wt % $SiO_2$ | 170 | 160 | 160 | 165 | None |
| 14 | Ta-20 wt % W-10 wt % Nb-10 wt % Zr-0.5 wt % $SiO_2$ | 150 | 190 | 200 | 200 | None |
| 15 Comparison Only | W-5 wt % Ni | 155 | 160 | 190 | No Discharge | Extreme (Crack Occurs) |
| 16 Comparison Only | Ni-5 wt % Zr | 170 | 180 | 175 | No Discharge | Extreme (Crack Occurs) |
| 17 Comparison Only | Ta-25 wt % Ti-0.4 wt % $SiO_2$ (No a cesium carbonate layer) | 270 | 290 | No Discharge | | Extreme |

EXAMPLE

A tantalum (Ta) powder having an average particle size of about 5 μm a titanium (Ti) powder having an average particle size of about 4 μm and a silicon oxide ($SiO_2$) powder having an average particle size of less than 0.05 μm are mixed at the following portions by weight: 25% Ti, 0.4% $SiO_2$ and the remainder Ta. The powder mixture is then compacted and compressed by means of a bar press machine. A cylindrical compact body 16 is formed with an outer diameter 1.7 mm, an inner diameter 0.8 mm and length 1.7 mm. This compact body 16 is then sintered for 30 minutes under a vacuum environment of $10^{-5}$ mm Hg at 1100°C. This sintered compact body 16 has a radial crushing strength of 23 Kg. The compact body 16, before sintering, has a radial crushing strength of 0.6 Kg.

The sintered compact body 16 is subsequently dipped into an ethanol liquid containing 10% cesium carbonate by weight. As a result, a cesium carbonate layer of about 1 μg is deposited on the whole surface of the body 16.

The sintered electrode 15 is secured at the edge of the tungsten rod 14 within the envelope 11. The distance between electrodes 12 and 13 is about 15 mm and xenon gas fills the envelope 11. An analysis of this discharge tube (example 3 below) can be made by applying a The above table shows the results of 17 different examples of sintered compact bodies. Examples 2, 5, 6, 8 and 9 through 14 were made by the same steps described above with reference to example 3.

Each of the examples 1, 4, 7 and 15 through 17 was made in a manner different than the present invention so that these sintered compact bodies could be compared with the present invention. Example 4 was manufactured as follows.

A tantalum (Ta) powder having an average particle diameter of about 5 μm and a titanium (Ti) powder having an average particle diameter of about 4 μm are mixed with each other at the proportions by weight of 25% Ti and the remainder Ta without any $SiO_2$ powder. The mixed powder is compacted and compressed by means of a bar press machine to form a cylindrical compacted body with outer diameter 1.7 mm, inner diameter 0.8 mm and length 1.7 mm. This compacted body is then sintered for 30 minutes under a vacuum environment of $10^{-5}$ mm Hg at 1100° C. The sintered compact body has a radial crushing strength of 12 Kg weight. After sintering, the sintered compact body is dipped into an ethanol liquid containing 10 wt% cesium carbonate. A cesium carbonate layer of about 1 μg is deposited on the body.

The other examples given for comparison only (examples 1, 7 and 15-17) were also prepared by the same steps mentioned above for example 4. These examples 1, 4, 7 and 15-17 of sintered compact bodies have a tendency to crack easily when fixed at the end of a tungsten rod because of low radial crushing strength.

As shown in the above table, the sintered compact body of example 4 has a relatively low initial starting voltage which is the same as the starting voltage for example 3. On the other hand, the starting voltage of example 4 increases gradually and unstably compared to the starting voltage of example 3. Blackening also occurred in example 4. Similarly, the sintered compact bodies in examples 1, 7 and 15-17 have unstable and increasing starting voltages and blackening occurs. Examples 15 and 16 contain nickel. These latter examples produce extreme blackening and have short lives (approximately 1000 discharge times).

From the results in the above table, preferrable components of the sintered compact body 16 have been discovered. The sintered compact body 16 of the present invention can be made of the components comprising 5-50 wt% Ti, 0.1-1.0 wt% $SiO_2$ (or $Al_2O_3$) and the remainder of Ta. Zirconium, hafnium, vanadium and mixtures thereof can be used in place of titanium. Tungsten, molybdenum, niobium and mixtures thereof can be used in place of tantalum. The cesium carbonate layer 17 effectively prevents increases in the starting voltage upon repeated discharges and it prevents the occurrence of blackening.

The cesium compound layer 17 also can be formed by the step of dipping the sintered compact body 16 into a dispersion which is prepared by dispersing cesium carbonate in butyl acetate. Although the cesium compound layer 17 may also be formed by using cesium chromate, the life of a discharge tube, particularly a tube such as a quenching tube, using cesium carbonate to form layer 17 may be two to three times the life of a discharge tube using cesium chromate.

Although illustrative embodiments of the invention have been described in detail with reference to the accompanying drawings, it is to be understood that the invention is not limited to those precise embodiments and that various changes and modifications may be effected therein by one skilled in the art without departing from the scope or sprit of the invention. For example, the cesium carbonate layer may contain small amounts of other alkali metals such as potassium and sodium while still achieving the essential results produced by the cesium carbonate layer as described above.

We claim:

1. A sintered electrode in a discharge tube comprising:

a sintered compact body including a high melting point metal, a gas getter and an additive for sintering; and a cesium carbonate compound layer deposited on said sintered compact body.

2. The sintered electrode of claim 1 wherein said sintered compact body comprises a gas getter in the range of 5 to 50% by weight, an additive for sintering in the range of 0.1 to 1.0% by weight and a high melting point metal forming the remainder.

3. The sintered electrode of claim 1 or 2 wherein said high melting point metal is a metal selected from the group consisting of tungsten, molybdenum, tantalum, niobium and mixtures thereof.

4. The sintered electrode of claim 1 or 2 wherein said gas getter is a metal selected from the group consisting of titanium, zirconium, vanadium, hafnium and mixtures thereof.

5. The sintered electrode of claim 1 or 2 wherein said additive for sintering is selected from the group consisting of silicon oxide and aluminum oxide, said additive further comprising a powder having particles less than 0.1 $\mu$m in average diameter.

* * * * *